US007083115B2

(12) United States Patent
Huffman

(10) Patent No.: US 7,083,115 B2
(45) Date of Patent: Aug. 1, 2006

(54) SPRAY GUN WITH REMOVABLE HEAT JACKET

(75) Inventor: David C. Huffman, Merrimack, NH (US)

(73) Assignee: Spraying Systems Co., Wheaton, IL (US)

( * ) Notice: Subject to any disclaimer, the term of this patent is extended or adjusted under 35 U.S.C. 154(b) by 302 days.

(21) Appl. No.: 10/264,014

(22) Filed: Oct. 3, 2002

(65) Prior Publication Data

US 2003/0066905 A1 Apr. 10, 2003

Related U.S. Application Data

(60) Provisional application No. 60/327,205, filed on Oct. 4, 2001.

(51) Int. Cl.
*B05C 1/00* (2006.01)

(52) U.S. Cl. ..... 239/135; 239/139

(58) Field of Classification Search ..... 239/128, 239/131, 133, 134, 135, 139, 600, 587.1, 239/587.5, 16–34
See application file for complete search history.

(56) References Cited

U.S. PATENT DOCUMENTS 3,902,850 A * 9/1975 Lehnert ..... 422/133
3,914,370 A * 10/1975 Lloyd et al. ..... 264/297.4
4,744,959 A * 5/1988 Punzar et al. ..... 422/231
5,117,482 A * 5/1992 Hauber ..... 392/492
5,171,613 A * 12/1992 Bok et al. ..... 427/422
5,216,898 A * 6/1993 Renegar et al. ..... 62/314
5,895,159 A * 4/1999 Liou ..... 401/2
5,960,996 A * 10/1999 Hsu ..... 222/113
5,979,787 A * 11/1999 Scarpa ..... 239/9
5,988,521 A * 11/1999 Nohynek ..... 239/11
6,135,360 A * 10/2000 Ren et al. ..... 239/136
6,136,379 A * 10/2000 Scarpa et al. ..... 427/426
6,349,887 B1 * 2/2002 Pyo ..... 239/137
6,481,641 B1 * 11/2002 Mieney ..... 239/139

FOREIGN PATENT DOCUMENTS

JP 361033201 A * 2/1986

* cited by examiner

*Primary Examiner*—Mohammad M. Ali
(74) *Attorney, Agent, or Firm*—Leydig, Voit & Mayer, Ltd.

(57) ABSTRACT

A spray gun having a relatively simple outer heat jacket designed to accommodate a multiplicity of fluid supply lines connected to the spray gun while effectively heating and maintaining the supply fluids directed through the gun to the desired temperature for optimum spraying. The heat jacket is mountable and removable from the spray gun without disconnecting the fluid supply lines to the spray gun or the heating fluid supply line to the heat jacket. The illustrated heat jacket is formed with a plurality of external, longitudinally extending open-ended slot each for receiving a respective fluid supply line connected to the spray gun and an internal heating fluid passageway composed of a plurality of interconnected, longitudinally extending heat transfer chambers through which heating fluid is directed in swirling fashion.

25 Claims, 3 Drawing Sheets

SPRAY GUN WITH REMOVABLE HEAT JACKET

FIELD OF THE INVENTION

The present invention relates generally to liquid spray guns or like spray devices which are supplied with both pressurized liquid and air, and more particularly, to a spray gun having means for maintaining the temperature of the supply liquid at a predetermined level for effective spraying.

BACKGROUND OF THE INVENTION

Viscous liquids, such as wax or sugar syrup, turn to a solid at room temperature, making atomization and spraying of such liquids difficult. Heating of supply pipes, valves, nozzles and other components of the spray device necessary for effective spraying of such liquids has been an ongoing problem in the industry. Moreover, for energy conservation purposes, many companies desire to use surplus heat from the manufacturing process in heating the spray gun components and supply lines.

Automatically operated spray guns commonly have a multiplicity of pressurized liquid and air lines connected to the spray gun body, typically through pipe nipples arranged about mixing and nozzle sections of the spray gun body. Encasing the gun body in a metal heating jacket through which a heating fluid can be circulated has resulted in complicated, difficult to manufacture, devices. In lieu thereof, it has been the practice to wrap metal heating tubing around the spray gun, snaking it in and around the liquid and air connections to form a heated surrounding enclosure. This practice is time consuming, results in a one of a kind heating jacket construction, is unpredictable in performance, and cumbersome to service in the field without time consuming, disassembly and reassembly. Hence a need has existed for a relatively simple spray gun heating jacket which can be operated with predictability and which permits easy removal of the heating jacket and/or spray gun for service and/or field replacement.

OBJECTS AND SUMMARY OF THE INVENTION

It is an object of the present invention to provide a spray gun having a relatively simple outer heat jacket designed to accommodate a multiplicity of fluid supply lines to the spray gun while effectively heating and maintaining the supply fluids to the desired temperature for optimum spraying.

Another object is to provide a spray gun with a heat jacket as characterized above which is attachable and detachable from the spray gun without disconnecting fluid supply lines to the spray gun or the heat jacket.

A further object is to provide a spray gun with a heat jacket of the above kind which is adaptable for heating both the supply line nipples connected to the spray gun and fluid mixing sections of the spray gun.

Still another object is to provide a spray gun heat jacket of the foregoing type which is adapted for generating a swirling action of heated fluid directed through the jacket for optimum heat transfer.

Yet a further object is to provide a spray gun heat jacket of such type which is adapted for economical manufacture.

In carrying out the invention, a spray gun is provided with a removable, hot fluid heat jacket that is fabricated from thermally conductive material and which can be readily slipped over the nozzle end of a spray gun and secured thereto in a manner that closely conforms to the body of the spray gun and does not interfere with the discharging spray pattern. The jacket is formed with a plurality of interconnected longitudinally extending internal heat transfer chambers and a plurality of external longitudinal slots designed to receive and closely surround the connections of liquid and air supply lines to the spray gun. To facilitate optimum heat transfer, the internal heat transfer chambers are configured to induce a swirling action of the heating fluid distributed through the jacket as the fluid is transferred along an interior flow path. The hot fluid transfers heat by convection to the heat jacket, and hence, by both convection and radiation to the spray gun body and connecting pipe nipples.

Figure 1:
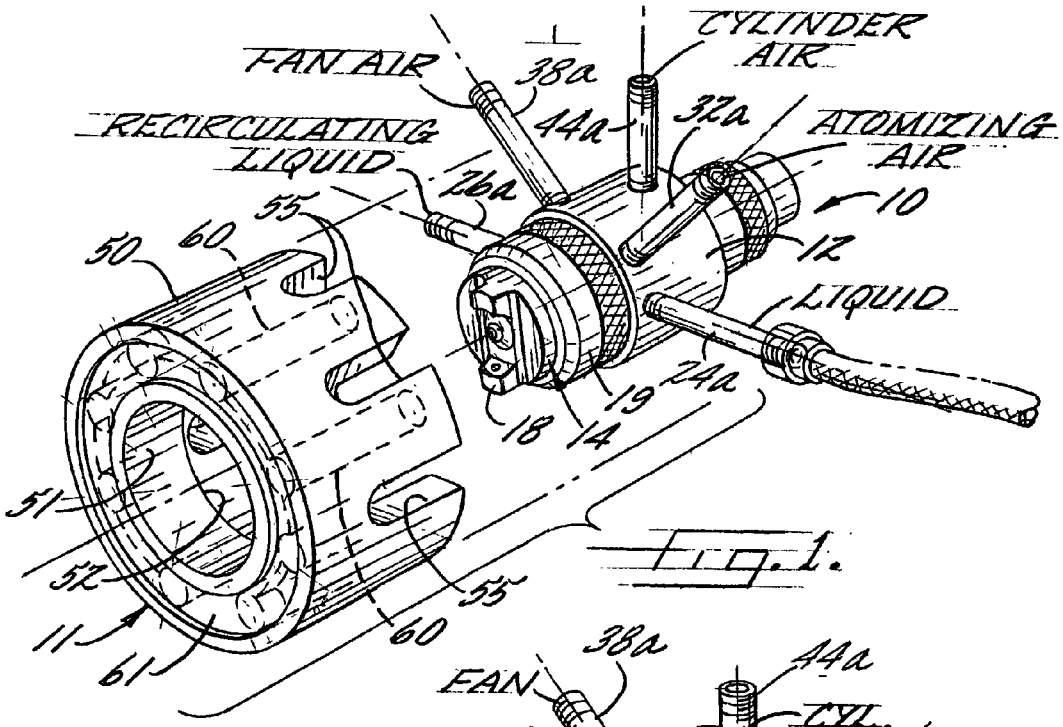
FIG. 1 is an exploded front perspective of an illustrative spray gun having a heat jacket in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENT

Referring now more particularly to the drawings, there is shown an illustrative spray gun or like spray device 10 having a heat jacket 11 in accordance with the present invention. The spray gun 10 comprises a nozzle body 12, a spray nozzle assembly 14 at a downstream end thereof, and a reciprocatable valve needle 15 for controlling discharging liquid spray from the nozzle assembly 14. The basic structure and mode of operation of the spray gun are known in the art, for example, as shown in U.S. Pat. No. 5,707,010 and U.S. application Ser. No. 09/892,138, both assigned to the same assignee of the present application, the disclosures of which are incorporated herein by reference. The overall structure and mode of operation of the spray gun 10 should be understood to be illustrative of only one example of a spray device with which the heat jacket of the present invention may be used.

Figure 4:
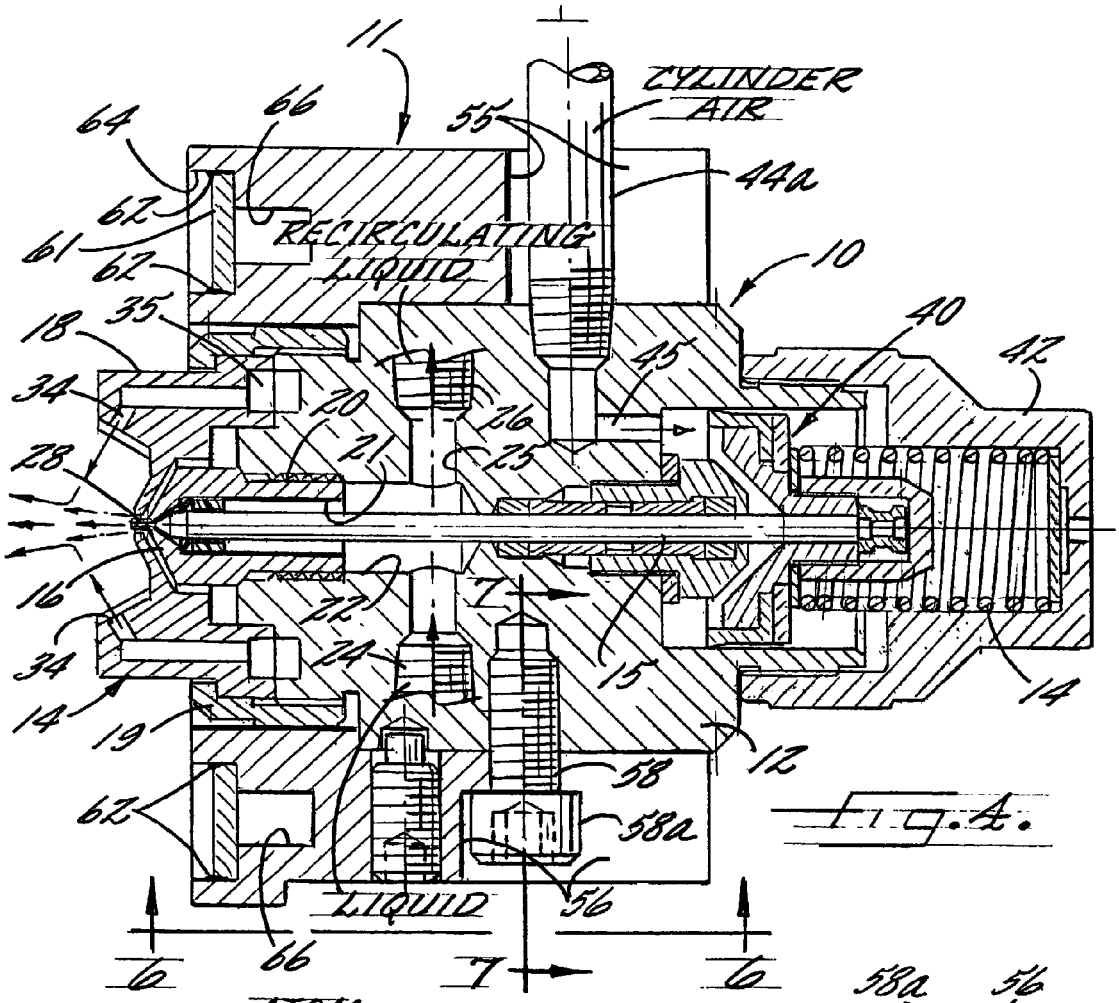
FIG. 4 is an enlarged longitudinal section of the spray gun and heat jacket taken in the plane of line 4—4 in FIG. 2.

The spray nozzle assembly 14 of the illustrated spray gun 10 is an external mix type nozzle, namely a nozzle in which liquid and pressurized air or other gases are mixed externally of their discharge orifices to produce an atomized spray. The spray nozzle assembly 14, as depicted in FIG. 4, in this case comprises a generally cylindrical nozzle body 16 and an air cap 18 releasably mounted at a discharge end of the nozzle body 16 by a retaining ring 19. The nozzle body 16 is affixed to a forward end of the spray gun body 12 by a threaded stem 20 and has a central liquid passageway 21 communicating with a liquid passage 22 in the nozzle body 16, which in turn communicates with a liquid supply port 24 (FIG. 4). The spray gun 10 in this instance has a recirculating liquid passage 25 communicating with a port 26 for permitting recirculation of the supply liquid during spraying if desired.

Figure 5:
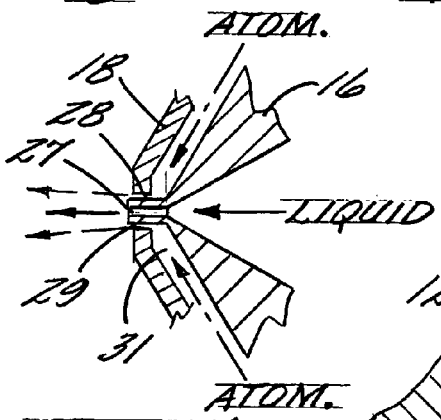
FIG. 5 is an enlarged fragmentary section of the discharge end of the illustrated spray gun.
Figure 6:
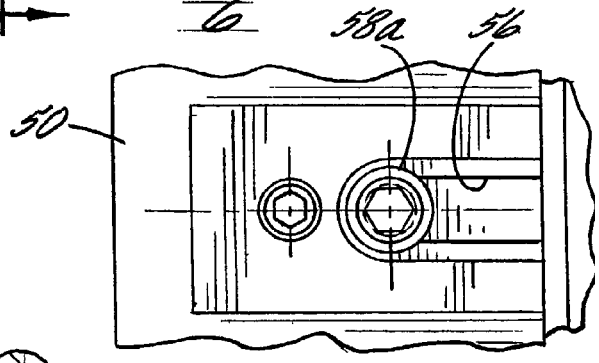
FIG. 6 is a fragmentary plan view, taken in the plane of line 6—6 in FIG. 4, showing the mounting bolt arrangement for releasably securing the heat jacket to the spray gun.
Figure 8:
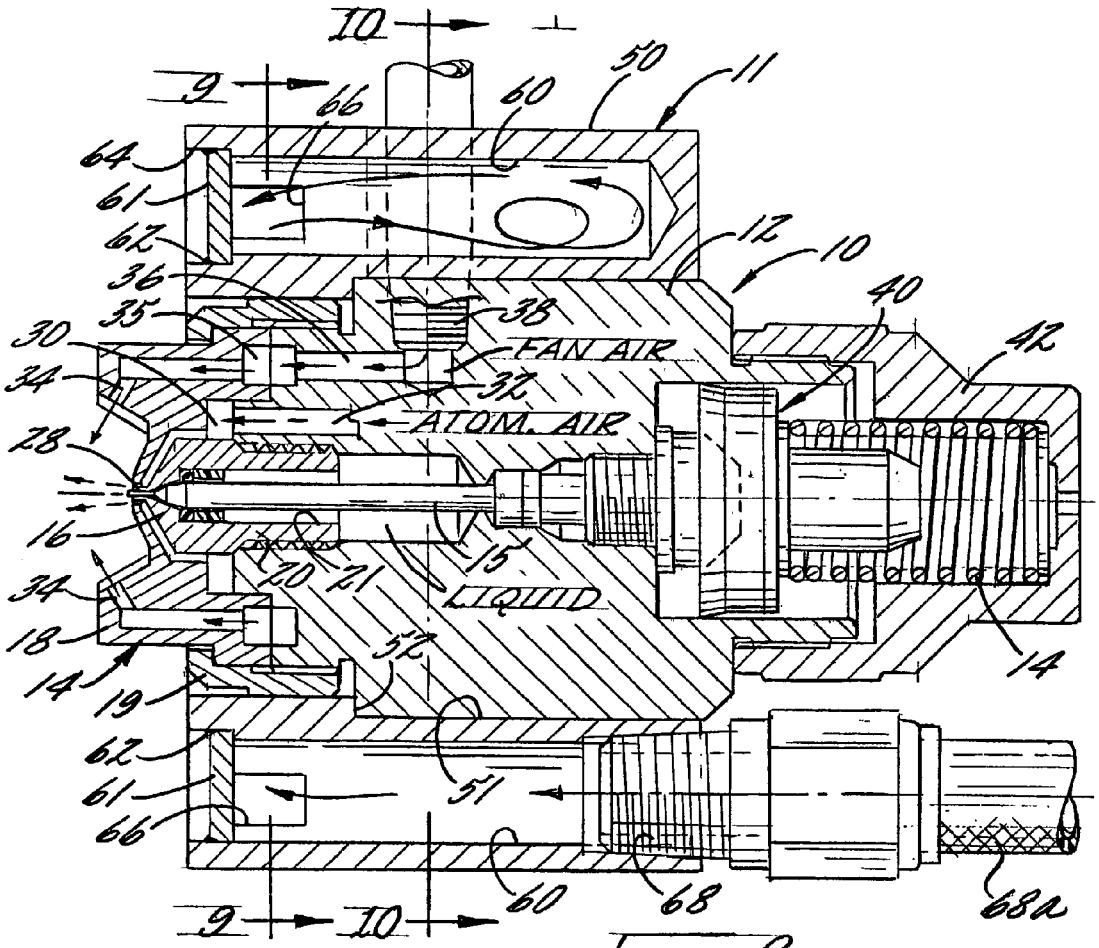
FIG. 8 is a longitudinal section of the illustrated spray gun and heat jacket, taken in the plane of line 8—8 in FIG. 3.
Figure 10:
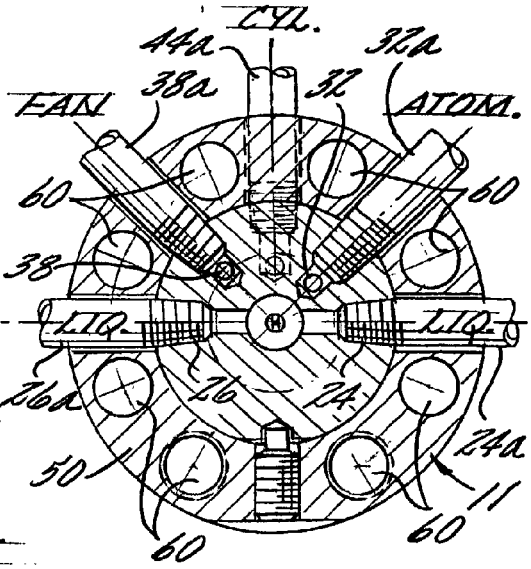

The illustrated nozzle body 16 has a forwardly extending nose portion 28 which defines a liquid discharge orifice 27 (FIG. 5). The nose portion 28 extends axially outwardly into a central opening of the air cap 18, which is slightly larger in diameter than the nose portion 28 for defining an annular atomizing air discharge orifice 29 which communicates with an annular air chamber 30 and an atomizing air passage 31 in the nozzle body 12, which in turn communicates with an atomizing air inlet port 32 (FIGS. 8 and 10). Atomizing air discharging through the annular passage 29 interacts with and atomizes liquid discharging from the liquid discharge orifice 27. For further atomizing, forming and directing the discharging liquid spray into the desired spray pattern, the air cap 18 is formed with a plurality of circumferentially spaced passages 34 communicating with a manifold or air chamber 35, which in turn communicates with a fan air passage 36 having a fan air inlet port 38.

Figure 2:
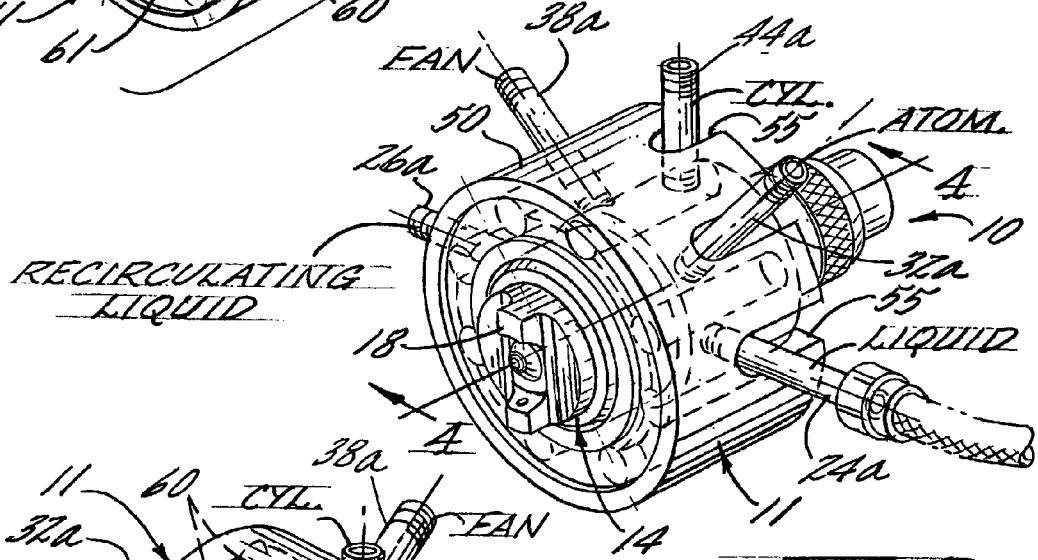
FIG. 2 is a front perspective, similar to FIG. 1, showing the heat jacket in mounted position on the spray gun.

For operating the valve needle 15, the rear section of the housing 12 carries a drive piston assembly 40 and a compression spring 41 which is confined between an outer side of the piston 40 and an end wall of a housing cap 42. The compression spring 41 biases the piston assembly 40, and hence the valve needle 15, forwardly to a fully seated, i.e. valve "closed" position as depicted in FIGS. 1 and 2. The valve needle 15 is moved axially in the opposite direction (to the right in FIG. 1) against the force of spring 41 by control drive air (referred to herein as "cylinder air") communicating from a cylinder air inlet port 44 and passage 45 to a forward side of the movable piston assembly 40. The supply of cylinder air may be controlled externally, such as by solenoid actuated valves, for controlled opening of the valve needle 15 to allow liquid to be discharged through the spray nozzle assembly 14. The valve needle 15 can thereby be selectively operated between on and off positions, including operation in a high speed cyclic on-off mode, e.g. as rapid as 180 on-off cycles per minute.

As will be understood by one skilled in the art, in spray guns having external mix nozzles of the foregoing type, liquid atomization may be controlled by varying the atomizing air and fan air pressures without changing the liquid flow rate. A flat spray pattern is controlled by varying the fan pressure air in conjunction with the atomizing air. Such operation is effective for spraying high viscosity liquids, coatings, and suspensions. As indicated above, however, it often is necessary to maintain such viscose liquids above a predetermined elevated temperature for effective atomization and spraying. By virtue of the multiplicity of liquid and air supply lines to the nozzle body, heretofore it has been difficult to provide effective heating of the spray gun without cumbersome heat jacket arrangements which hinder easy access to the spray gun. Indeed, in the illustrated embodiment, the five liquid and gas supply ports 24, 26, 32, 38, 44, have respective radially extending nipples 24*a*, 26*a*, 32*a*, 38*a*, 44*a* threadedly engaged with the respective ports, which in turn each are connected to a respective fluid supply line (FIG. 10).

In accordance with the invention, the heat jacket has a relatively simple annular or ring-shaped construction that is removably positionable over the spray gun in close fitting relation to the spray gun body, the nozzle assembly, and the supply line nipples fixed to the spray gun body for efficient heat transfer to the supply fluids. More particularly, the heat jacket is formed with a plurality of external slots which receive the liquid and air supply line connecting nipples and a plurality of interconnected internal heating chambers disposed between the external slots that facilitate efficient heat transfer to the spray gun body and the fluid supply line connecting nipples. To this end, the illustrated heat jacket 11 comprises an annular body 50 preferably machined of thermally conductive metal material. The heat jacket body 50 has a central bore 51 sized for enabling the heat jacket 11 to be slipped over the nozzle end of the spray gun 10 in close surrounding relation about the spray gun body 12. To facilitate predetermined positioning of the heat jacket 11 on the spray gun 10, the axial bore 51 of the heat jacket body 50 is formed with a step 52 which is positionable against a shoulder of the nozzle body 12. The heat jacket 11 in this instance has an axial length which extends a substantial axial length of the spray gun body 12 and at least in partially overlying relation to the spray nozzle assembly 14 so as to substantially encompass and surround the liquid and pressurized air passages within the spray gun.

Figure 7:
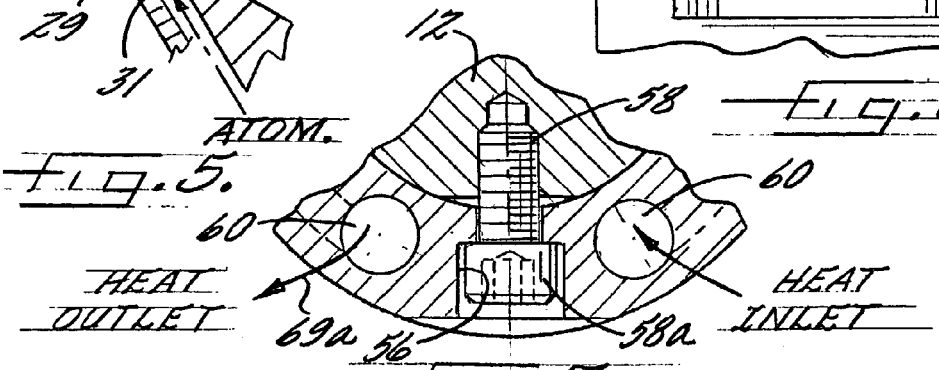
FIG. 7 is a fragmentary section of the heat jacket mounting bolt arrangement taken in the plane of line 7—7 in FIG. 4.

In carrying out the invention, the heat jacket body 50 is formed with a plurality of circumferentially spaced rearwardly opening slots 55 adapted to receive and envelope the spray gun supply line nipples 24*a*, 26*a*, 32*a*, 38*a*, 44*a* as an incident to positioning of the heat jacket 11 onto the spray gun 10. The slots 55, which preferably are milled into a rear side of the heat jacket body 50, in this case extend axially lengths into the body corresponding to the location of the supply line nipple to be received in the respective slot, such that the heat jacket body is in close fitting relation about each supply line nipple, except on the rearwardly opening side of the slot. With the heat jacket oriented with the slots 55 in aligned relation to the supply line nipples, as depicted in FIG. 1, the jacket can be readily positioned over the spray gun from a front side or nozzle end, as depicted in FIG. 2. For securing the heat jacket 11 in mounted position on the spray gun 10, the heat jacket 11 is formed with a further rearwardly opening longitudinal slot 56 sized to receive the shaft of a retaining bolt 58 that is screwed into a threaded bore of the spray gun body 12, the head 58*a* of which is tightened against the periphery of the heating jacket body securing the jacket in position (FIGS. 4 and 7).

In further carrying out the invention, the heat jacket 11 is formed with a plurality of interconnected heat transfer chambers 60 at circumferentially spaced locations about the heat jacket for efficient heat transfer to the spray gun 10 and supply line nipples 24*a*, 26*a*, 32*a*, 38*a*, 44*a* fixed thereto. The heat transfer chambers 60 in this case are in the form of a plurality of cylindrical bores having axes parallel to the longitudinal axis of the heat jacket 11 and spray gun 10. The bores 60 may be formed by drilling cylindrical holes into the heat jacket body 50 from a front side, with the holes extending a substantial length of the heat jacket and being closed at their front opening end by an annular cover plate 61 fixed, such as by welding welments 62, within an annular recess 64 in the front face of the heat jacket body 50. The longitudinal heat transfer chambers 60 in this case extend circumferentially between the fluid supply line receiving slots 55 such that each fluid supply line nipple 24*a*, 26*a*, 32*a*, 38*a*, 44*a* is disposed in close lateral relation between a pair of longitudinal heat transfer chambers 60.

Figure 3:
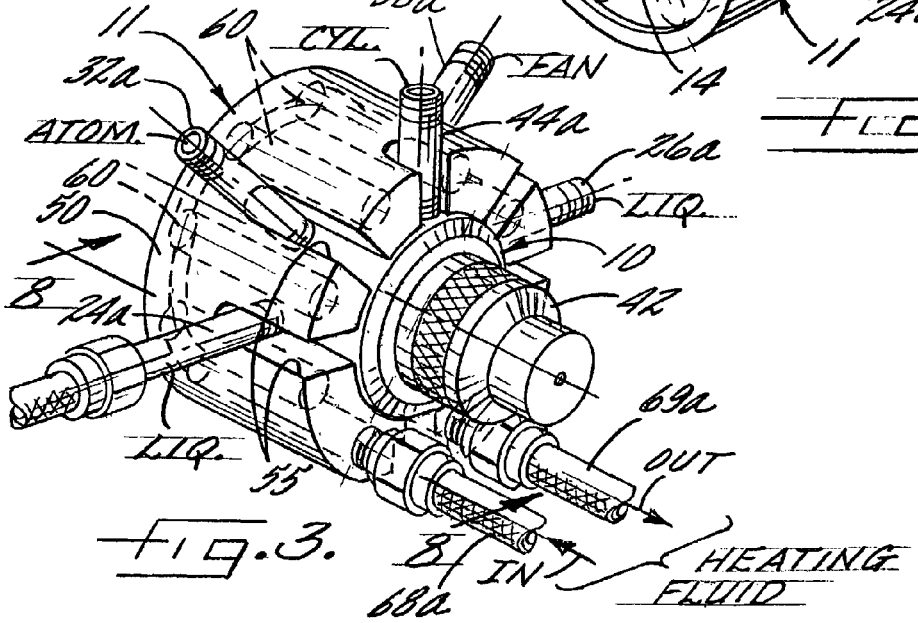
FIG. 3 is a rear perspective of the spray gun with the heat jacket in mounted position.

For continuously directing and circulating heated fluid through the heat transfer chambers 60, the heat transfer chambers 60 are interconnected by a generally circular flow channel 66, which in the illustrated embodiment is milled into a front side of the heat jacket body 50 in intersecting relation to each of the longitudinal heat transfer chambers 60. Inlet and outlet ports 68, 69 connected to heating fluid supply and return lines 68*a*, 69*a* communicate through a rear side of the heat jacket body 50 with the two lowermost chambers 60 at opposite ends of the generally circular channel 66, and hence in turn with the circular channel 66 (FIGS. 3 and 5). It will be understood that a hot fluid from an outside source, such as a fluid supply source heated in connection with a related manufacturing process, may be circulated in either direction through the generally circular channel 66 and the longitudinal heat transfer chambers 60.

Figure 9:
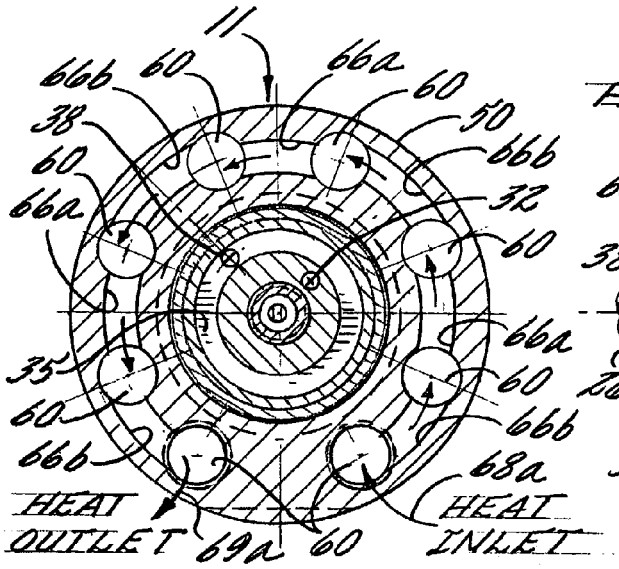
FIGS. 9 and 10 are vertical sections of the spray gun and heat jacket, taken in the planes of lines 9—9 and 10—10, respectively, in FIG. 8.

In keeping with a further aspect of the invention, the generally circular heating fluid channel 66 communicates in off-centered relation with each longitudinal heat transfer chamber 60 so as to induce a swirling action to liquid directed to the heat transfer chambers 60 for enhanced circulation and heat transfer. The generally circular chamber 66 in this case, as best depicted in FIG. 9, comprises a plurality of generally arcuate or circular channel segments 66*a*, 66*b*, which interconnect between the ends of respective pairs of the longitudinal heat transfer chambers 60. Alternative channel segments 66*a*, 66*b* are radially offset with respect to each other such that the channel segments 66*a* communicate tangentially with an inner side of alternative cylindrical heat transfer chambers 60 for directing a swirling movement in one direction and the alternative channel segments 66*b* communicate generally tangentially with an outer side of alternative transfer heat chambers 60 for creating a swirling movement of fluid in those chambers in an opposite direction. Such swirling action enhances the circulation of heating fluid in the chamber 60 and reduces the chance of sediment build up in the heat transfer chambers 60 which could otherwise reduce the rate of heat transfer from the chambers 60 to the spray gun 10. It will be understood by one skilled in the art that the exterior geometry of the heat jacket 11 and the volume and wall surface areas of the heat transfer chambers 60 and the connecting channel 66 may be sized to optimize thermal transfer from the flow of hot fluid through the heat jacket 11 to the spray gun 10 and the fluid supply line nipples under normal operating conditions.

During usage, it can be seen that the heat jacket 11 is readily positionable onto the spray gun 10 and secured in mounted position by the securement bolt 58. The heating fluid inlet and return lines 68*a*, 69*a* may be connected to the heat jacket 11 prior to or subsequent to mounting on the spray gun 10. Moreover, simple loosening of the retaining bolt 58 enables the heat jacket 11 to be pulled off the nozzle end of the spray gun 10 without the need for disconnecting the heating fluid supply and return lines 68*a*, 69*a* from the heat jacket 11 or the fluid supply lines to the spray gun 10.

It will be further appreciated by one skilled in the art that the heat jacket is susceptible to various modifications without departing from the invention. For example, the longitudinal heat transfer chambers 60 may be formed by drilling holes completely through the heat jacket body 50 and plugging the rear end thereof. Likewise, the connecting channel 66 may be formed by straight line segments or holes drilled between the heat transfer chambers 60 with opposite ends of the holes plugged. Still alternatively, the connecting channel 66 between the longitudinal heat transfer chambers 60 may-be incorporated or recessed into a mating surface of the cover plate 61, with inlet and outlet ports connecting directly into respective ends of the heat transfer chambers.

Alternately, the heating fluid inlet and/or the outlet ports 68, 69 may be incorporated into the cover plate 61. Furthermore, a backside cover plate or plates may incorporate or enclose segments of the fluid channel 66 between alternate heat transfer chambers 60, providing an end-to-end component to the flow pattern of hot fluid through the heat transfer chambers 60. As a consequence thereof, it will be apparent that the chambers 60 may be connected in serial or parallel arrangements or in a combination of serial and parallel connections, by using alternate configurations of the fluid channel 66.

As yet another variation, a self-actuating thermostat/valve assembly may be incorporated into the heat jacket to regulate the temperature of the heat jacket. Alternatively, a simple temperature sensor may be incorporated into the heat jacket for communicating temperature indications to a controller of the external source of the heating fluid. Other temperature control configurations will be apparent to those skilled in the art within the scope of the invention.

As further alternatives, the heat jacket may be made of any thermally conductive materials including numerous metals, metal alloys, plastics and other polymeric materials. The heat jacket also may be milled, cast, molded, laminated or otherwise fabricated or formed by any means resulting in a suitable structure compatible with a selected model, size or style of spray gun and incorporating the features described herein.

From the foregoing, it can be seen that a spray gun is provided with a relatively simple outer heat jacket designed to accommodate a multiplicity of fluid supply lines connected to the gun while effectively heating and maintaining the supply fluids to the desired temperature for optimum spraying. The heat jacket is mountable and removable from the spray gun-without disconnecting the supply lines to the spray gun or the heating fluid supply line to the heat jacket. Furthermore, the jacket is designed to effect efficient heat transfer to both the spray gun and to the supply line connecting nipples.

What is claimed:

1. A spraying apparatus comprising a spray device having at least one inlet port for connection to a fluid supply line for directing fluid received from said fluid supply line in a desired spray pattern, a heat jacket separate from said spray device having a body made of thermally conductive material and sized for removable positioning on said spray device in close conforming relation to the spray device without interference with the discharging fluid spray pattern from the spray device, said heat jacket body being formed with at least one open-sided opening for receiving a supply line connected to said spray device inlet port as an incident to positioning of said heat jacket on said spray device, and said heat jacket body being formed with a heating fluid passageway internally within a wall structure of the body, said heating fluid passageway having an inlet port for connection to a heating fluid supply line for enabling heating fluid to be circulated through said heat jacket for heating said heat jacket body and in turn said spray device.

2. The spray apparatus of claim 1 in which said heat jacket is removable from said spray device without disconnection of said fluid supply line from said spray device inlet port and without disconnection of said heating fluid supply line from said heating jacket.

3. The spray apparatus of claim 1 in which said spray device is an air atomizing spray device having at least one liquid inlet port and at least one pressurized air inlet port, and said heat jacket body being formed with a plurality of said slots each for receiving a respective fluid supply line coupled to said liquid inlet port and said pressurized air inlet port.

4. The spray apparatus of claim 1 in which said spray device has a plurality of fluid inlet ports each for receiving a respective fluid supply line, and said heat jacket body is formed with a plurality of open-sided openings in the form of slots which each receive a respective fluid supply line as an incident to positioning of said heat jacket on said spray device.

5. The spray apparatus of claim 4 in which said fluid supply lines are connected to said spray device inlet ports in radially extending relation to said spray device through said heat jacket slots.

6. The spray apparatus of claim 5 in which said slots extend longitudinally from a rear side of said heat jacket body.

7. The spraying apparatus of claim 1 in which said fluid supply line includes a connecting element coupled to said at least one inlet port in outwardly extending relation to said spray device, said connecting element being positioned within said heat jacket opening as an incident to positioning of said heat jacket on said spray device.

8. The spray apparatus of claim 1 in which said spray device includes a nozzle at a discharge end of the spray device, and said heat jacket is positionable over said spray device from the nozzle end thereof.

9. The spray apparatus of claim 1 in which said heat jacket has a central opening extending through said heat jacket body, and said heat jacket is positionable over said spray device with said spray device extending through said central opening.

10. The spray apparatus of claim 9 in which said heating jacket central opening extends longitudinally through said heat jacket, and said heating jacket supply line receiving opening is an open-sided slot aligned in parallel relation to said central opening.

11. The spray apparatus of claim 10 in which said heating fluid passageway includes a plurality of interconnected heat transfer chambers, each said heat transfer chamber being aligned parallel to said heat jacket central opening and slot.

12. The spraying apparatus of claim 1 in which said spray device includes an elongated body and a spray nozzle assembly mounted at a downstream end of said body, and said heat jacket body is positionable over a substantial length of said spray device body and at least a portion of said spray nozzle assembly.

13. The spray apparatus of claim 1 in which said heating fluid passageway includes a plurality of chambers, and at least one of said chambers is disposed in close relation to said fluid supply line receiving opening in said heat jacket body.

14. The spray apparatus of claim 1 in which said heating fluid passageway including a plurality of cylindrically shaped heat transfer chambers, and said heat jacket having at least one connecting passage for permitting communication of heating fluid sequentially through said heat transfer chambers from said heating fluid inlet port.

15. The spray apparatus of claim 14 in which said connecting passage communicates tangentially with said heat transfer chambers for creating a swirling movement of heating fluid communicated to each heat transfer chamber.

16. The spray apparatus of claim 15 in which said connecting passage communicates with one side of some of said heat transfer chambers for effecting a swirling movement of heating fluid in said chambers in one direction, and said connecting passage communicates with other of said heat transfer chambers on an opposite side thereof for effecting swirling movement of heating fluid in said chambers in an opposite direction than the heating fluid swirling movement in said some chambers.

17. The spray apparatus of claim 16 in which said connecting passage comprises a plurality of passage segments which each are interconnected between two of said heat transfer chambers.

18. A spraying apparatus comprising a spray device having at least one inlet port for connection to a fluid supply line for directing fluid received from said fluid supply line in a desired spray pattern, a heat jacket having a body made of thermally conductive material and sized for positioning on said spray device in close conforming relation to the spray device without interference with the discharging fluid spray pattern from the spray device, said heat jacket body being formed with a heating fluid passageway internally within a wall structure of the body, said heating fluid passageway having an inlet port for connection to a heating fluid supply line for enabling heating fluid to be circulated through said heat jacket for heating said heat jacket body and in turn said spray device, and said heat jacket being removable and repositionable on said spray device without disconnection of said fluid supply line to said spray device or disconnection of said heating fluid supply line to said heat jacket.

19. The spraying apparatus of claim 18 in which said spray device includes a plurality of fluid inlet ports each connected to a respective fluid supply line.

20. The spray apparatus of claim 18 in which said heat jacket has a central opening extending through said heat jacket body, said heat jacket being positionable over said spray device with said spray device extending through said central opening.

21. A spraying apparatus comprising:

a spray device having at least one side inlet port coupled to a fluid supply line by a connector element for directing fluid received from said fluid supply line in a determined spray pattern, a heat jacket separate from said spray device having a body made of thermally conductive material and being formed with a central opening sized for removable positioning about said spray device in close conforming relation to the spray device without interference with the discharging fluid spray pattern from said spray device, said jacket body being formed with at least one external open-sided slot for receiving said fluid supply line connector element as an incident to positioning of said heat jacket over said spray device, and said heat jacket body being formed with a heating fluid passageway internally within a wall structure of the body, said heating fluid passageway having an inlet port for connection to a heating fluid supply line for enabling heating fluid to be circulated through said heat jacket for heating said heat jacket body and in turn said spray device and the fluid supply line connector element received in said heat jacket slot.

22. A spraying apparatus comprising a spray device having a plurality of fluid inlet ports each connected to a respective fluid supply line, said spray device being operable for directing fluids received from said fluid supply lines in a desired spray pattern, a heat jacket having a body made of thermally conductive material said sized for positioning on said spray device in close conforming relation to the spray device without interference with the discharging fluid spray pattern from the spray device, said fluid supply lines each communicating with said spray device inlet ports through a respective opening in said heat jacket, said heat jacket being formed with an internal heating fluid passageway with an inlet port for connection to a heating fluid supply line for enabling heating fluid to be circulated through said heat jacket for heating said jacket and spray device, and said heat jacket being removable and repositionable on said spray device without disconnection of said fluid supply lines from said spray device or disconnection of said heating fluid supply line from said heat jacket.

23. The spraying apparatus of claim 22 in which said openings are rearwardly opening slots in said heat jacket.

24. A spraying apparatus comprising a spray device having at least one inlet port for connection to a fluid supply line for directing fluid received from said fluid supply line in a desired spray pattern, a heat jacket having a body made of thermally conductive material and sized for positioning on said spray device in close conforming relation to the spray device without interference with the discharging fluid spray pattern from the spray device, said heat jacket having a central opening extending through said heat jacket body and being positionable over said spray device with said spray device extending through said central opening, said heat jacket being formed with an internal heating fluid passageway with an inlet port for connection to a heating fluid supply line for enabling heating fluid to be circulated through said heat jacket for heating said spray device, said heating fluid passageway including a plurality of interconnected heat transfer chambers with each said heat transfer chamber being aligned parallel to said heat jacket central opening, and said heat jacket being removable and repositionable on said spray device without disconnection of said fluid supply line to said spray device or disconnection of said heating fluid supply line to said heat jacket.

25. The spray apparatus of claim 24 in which said heat transfer chambers are cylindrically shaped, said heat jacket having at least one connecting passage for permitting communication of heating fluid sequentially through said heat transfer chambers from said heating fluid inlet port, and said connecting passage communicating tangentially with said heat transfer chambers for creating a swirling movement of heating fluid communicated to each heat transfer chamber.

* * * * *